US012264899B2

(12) United States Patent
Norris et al.

(10) Patent No.: US 12,264,899 B2
(45) Date of Patent: Apr. 1, 2025

(54) ANCHORS FOR ENTANGLING PROJECTILES

(71) Applicant: Wrap Technologies, Inc., Tempe, AZ (US)

(72) Inventors: Elwood Norris, Poway, CA (US); John Bailey, Poway, CA (US); Milan Cerovic, Tempe, AZ (US); David Richter, Tempe, AZ (US)

(73) Assignee: Wrap Technologies, Inc., Tempe, AZ (US)

( * ) Notice: Subject to any disclaimer, the term of this patent is extended or adjusted under 35 U.S.C. 154(b) by 19 days.

(21) Appl. No.: 18/295,713

(22) Filed: Apr. 4, 2023

(65) Prior Publication Data

US 2024/0337471 A1 Oct. 10, 2024

(51) Int. Cl.
*F41H 13/00* (2006.01)

(52) U.S. Cl.
CPC ..... *F41H 13/0006* (2013.01)

(58) Field of Classification Search
CPC ..... F41B 15/10; F41H 13/0006; F42B 12/66; F42B 12/68
USPC ..... 102/504, 400
See application file for complete search history.

(56) References Cited

U.S. PATENT DOCUMENTS 183,457 A * 10/1876 Greenough ..... F42B 10/14 114/295
289,909 A * 12/1883 Griffin ..... F42B 12/66 102/504
724,326 A * 3/1903 Pepperling ..... F42B 10/14 102/400
814,116 A * 3/1906 Dalton ..... F42B 12/66 102/504
851,824 A * 4/1907 Meyer ..... F42B 12/66 102/504
858,009 A * 6/1907 Meyer ..... F42B 12/66 102/504
1,229,421 A * 6/1917 Downs ..... F42B 12/66 102/504
1,247,331 A 11/1917 Robinson
(Continued)

FOREIGN PATENT DOCUMENTS

CA 2162221 A1 5/1996
DE 3522661 A1 1/1987
(Continued)

*Primary Examiner* — Joshua E Freeman
*Assistant Examiner* — Benjamin S Gomberg
(74) *Attorney, Agent, or Firm* — Thorpe North & Western, LLP; Jason R. Jones

(57) ABSTRACT

An anchor for use in an entangling projectile includes a head segment and a tail segment, the segments being positionable relative to one another in at least a first, primary configuration and a second, displaced configuration. A shank segment is intermediate the head segment and tail segment and a biasing element is associated with one or more of the head, tail and shank segments and is operable to apply a restorative force to one or both of the head segment and the tail segment. The restorative force tends to return the respective segments into the primary configuration after being moved into the displaced configuration. One or more hook segments are carried by the head portion and are operable to engage the person of a subject about which the entangling projectile has been deployed.

10 Claims, 9 Drawing Sheets

(56) References Cited

U.S. PATENT DOCUMENTS 1,275,561 A * 8/1918 Jennings ..... F41A 1/04 102/504
1,298,851 A * 4/1919 Aleksandrowicz ..... F42B 12/66 102/504
1,315,721 A * 9/1919 Hall ..... F42B 12/68 102/504
1,343,747 A 6/1920 Radakovich
1,488,182 A * 3/1924 Whelton ..... F42B 12/66 102/504
2,283,065 A * 5/1942 Hawkins ..... F42B 12/66 102/504
2,373,363 A 4/1945 Wellcome
2,455,784 A 12/1948 Lapsensohn
2,668,499 A 2/1954 Gaston
3,105,438 A * 10/1963 Aberg ..... F42B 12/68 102/354
3,340,642 A 9/1967 Vasiljevic
3,484,665 A 12/1969 Mountjoy et al.
3,583,087 A 6/1971 Huebner
3,729,222 A 4/1973 McNulty
3,773,026 A 11/1973 Romero
3,921,614 A 11/1975 Fogelgren
4,008,667 A * 2/1977 Look ..... F42B 10/50 244/3.28
4,027,418 A 6/1977 Baldi et al.
4,166,619 A 9/1979 Bergmann et al.
4,193,386 A 3/1980 Rossi
4,253,132 A 2/1981 Cover
4,318,389 A 3/1982 Kiss, Jr.
4,327,644 A * 5/1982 Stancil ..... F42B 12/68 102/504
4,466,417 A 8/1984 Mulot et al.
4,559,737 A 12/1985 Washington
4,750,692 A 6/1988 Howard
4,752,539 A 6/1988 Vatter
4,912,869 A 4/1990 Govett
4,962,747 A 10/1990 Biller
5,003,886 A * 4/1991 Pahnke ..... F42B 14/061 102/521
5,103,366 A 4/1992 Battochi
5,145,187 A 9/1992 Lewis
5,314,196 A 5/1994 Ruelle
5,326,101 A * 7/1994 Fay ..... F41H 13/0006 463/47.4
5,372,118 A 12/1994 Schmidt, III et al.
5,561,263 A * 10/1996 Baillod ..... F42B 12/66 102/504
5,654,867 A 8/1997 Murray
5,706,795 A 1/1998 Gerwig
5,786,546 A 7/1998 Simson
5,814,753 A * 9/1998 Rieger ..... F42B 12/66 102/504
5,831,199 A 11/1998 McNulty
5,898,125 A 4/1999 Mangolds et al.
5,904,132 A 5/1999 Biller
5,943,806 A 8/1999 Underwood
5,962,806 A 10/1999 Coakley et al.
6,381,894 B1 5/2002 Murphy
6,575,073 B2 6/2003 McNulty
6,636,412 B2 10/2003 Smith
6,880,466 B2 4/2005 Carman
6,898,887 B1 5/2005 Stratbucker
7,042,696 B2 5/2006 Smith et al.
7,065,915 B2 6/2006 Chang
7,114,450 B1 10/2006 Chang
7,143,539 B2 12/2006 Cerovic et al.
7,218,501 B2 5/2007 Keely
7,237,352 B2 7/2007 Keely et al.
7,314,007 B2 1/2008 Su
7,327,549 B2 2/2008 Smith et al.
7,444,939 B2 11/2008 McNulty et al.
7,444,940 B2 11/2008 Kapeles et al.
7,640,839 B2 1/2010 McNulty, Jr.
7,673,411 B1 3/2010 Baldwin
7,778,005 B2 8/2010 Saliga
7,859,818 B2 12/2010 Kroll et al.
7,900,388 B2 3/2011 Brundula et al.
7,905,180 B2 3/2011 Chen
7,950,329 B1 5/2011 Nemtyshkin et al.
7,984,676 B1 7/2011 Gavin et al.
8,082,199 B2 12/2011 Kwok
8,231,474 B2 7/2012 Stethem
8,261,666 B2 9/2012 Garg
8,339,763 B2 12/2012 McNulty, Jr.
8,441,771 B2 5/2013 Hinz et al.
8,677,675 B2 5/2014 Koch
8,857,305 B1 10/2014 Tseng
8,896,982 B2 11/2014 Beecher et al.
8,899,139 B2 12/2014 Brill et al.
9,025,304 B2 5/2015 Brundula et al.
9,134,099 B2 9/2015 Tseng
9,157,694 B1 10/2015 Tseng
9,220,246 B1 12/2015 Roman
9,255,765 B2 2/2016 Nelson
9,303,942 B2 4/2016 Sievers
9,414,578 B2 8/2016 Thornbrough
9,581,417 B2 2/2017 Tseng
10,107,599 B2 10/2018 Norris et al.
10,408,588 B1 * 9/2019 Manley ..... F42B 14/064
10,852,114 B2 12/2020 Norris et al.
2002/0134365 A1 9/2002 Gray
2003/0165041 A1 9/2003 Stethem
2003/0165042 A1 9/2003 Stethem
2005/0166441 A1 8/2005 Mattox
2007/0101893 A1 5/2007 Shalev et al.
2007/0137085 A1 * 6/2007 Aske ..... F42B 5/02 42/70.11
2007/0264079 A1 11/2007 Martinez et al.
2009/0084284 A1 4/2009 Martinez et al.
2010/0126483 A1 5/2010 Makowski
2010/0315756 A1 12/2010 Gavin
2011/0005373 A1 1/2011 Martinez et al.
2012/0019975 A1 1/2012 Hanchett et al.
2012/0210904 A1 8/2012 Merems
2014/0331984 A1 11/2014 Brahler, II et al.
2015/0040445 A1 * 2/2015 Li ..... G09F 7/18 40/606.01
2015/0075073 A1 3/2015 Sylvester
2015/0168107 A1 6/2015 Tseng
2016/0161225 A1 6/2016 Searle et al.
2017/0160060 A1 * 6/2017 Purvis ..... F41H 13/0006
2017/0241751 A1 8/2017 Nerheim
2017/0276460 A1 * 9/2017 Norris ..... F42B 14/00
2017/0276461 A1 * 9/2017 Norris ..... F42B 5/03
2022/0260345 A1 8/2022 Cerovic et al.

FOREIGN PATENT DOCUMENTS

JP 2011/106748 A 6/2011
RU 2722231 C2 5/2020
WO WO 2022/047435 A1 3/2022

* cited by examiner

ANCHORS FOR ENTANGLING PROJECTILES

BACKGROUND OF THE TECHNOLOGY

Field of the Technology

The present technology relates generally to entangling projectiles for use in less-than-lethal projectile launchers. More particularly, the present technology relates to configurations of anchors of entangling projectiles and related methods.

Related Art

The present Applicant has pioneered the use of launchers for directing entangling projectiles toward a subject. Such launchers have been successfully used to temporarily impede a subject's ability to walk, run, or use his or her arms in cases where law enforcement, security personnel or military personnel wish to detain a subject, but do not wish to use lethal or harmful force or to engage in close proximity hand-to-hand combat. This technology provides a manner by which the arms or legs of a subject can be temporarily tethered or bound, to the extent that the subject finds it difficult to continue moving in a normal fashion.

While such systems have proven very effective, improving the frequency at which anchors of entangling projectiles successfully engage a subject continues to be a design goal.

SUMMARY OF THE INVENTION

In accordance with one aspect of the technology, an anchor for use in an entangling projectile is provided. The anchor can include at least two segments, a head segment and a tail segment. The at least two segments can be positionable relative to one another in at least a first, primary configuration and a second, displaced configuration. A biasing element can be associated with one or both of the head segment and the tail segment, the biasing element being operable to apply a restorative force to one or both of the head segment and the tail segment. The restorative force tends to return the respective segments into the primary configuration after being moved into the displaced configuration. One or more hook segments can be carried by the head or the tail portion, the one or more hook segments operable to engage the person of a subject about which the entangling projectile has been deployed.

In accordance with another aspect of the technology, an anchor for use in an entangling projectile is provided. The anchor can include a head segment and a tail segment, the head segment and tail segment being positionable relative to one another in at least a first, primary configuration and a second, displaced configuration. A shank segment can be intermediate the head segment and tail segment. A biasing element can be associated with one or more of the head segment, the tail segment and the shank segment. The biasing element can be operable to apply a restorative force to one or both of the head segment and the tail segment. The restorative force can tend to return the respective segments into the primary configuration after being moved into the displaced configuration. One or more hook segments can be carried by the tail portion, the one or more hook segments operable to engage the person of a subject about which the entangling projectile has been deployed.

In accordance with another aspect of the technology, an entangling projectile for use in a launcher is provided. The entangling projectile can include a pair of anchors. Each anchor can include a head segment and a tail segment, the head segment and tail segment being positionable relative to one another in at least a first, primary configuration and a second, displaced configuration. A shank segment can be intermediate the head segment and tail segment. A biasing element can be associated with one or more of the head segment, the tail segment and the shank segment. The biasing element can be operable to apply a restorative force to one or both of the head segment and the tail segment. The restorative force can tend to return the respective segments into the primary configuration after being moved into the displaced configuration. One or more hook segments can be carried by the tail portion, the one or more hook segments operable to engage the person of a subject about which the entangling projectile has been deployed. A tether can be coupled to and can extend between each of the respective head segments.

BRIEF DESCRIPTION OF THE DRAWINGS

The following drawings illustrate exemplary embodiments for carrying out the invention. Like reference numerals refer to like parts in different views or embodiments of the present invention in the drawings.

DETAILED DESCRIPTION

Figure 1:
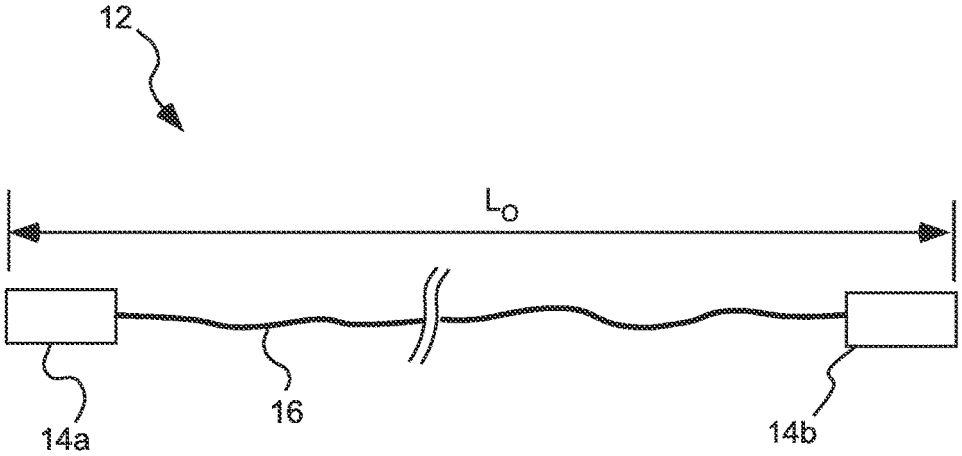
FIG. 1 (PRIOR ART)
FIG. 1 is a top, bottom, front or rear partially sectioned view of a conventional entangling projectile extended substantially to its full length.
Figure 2A:
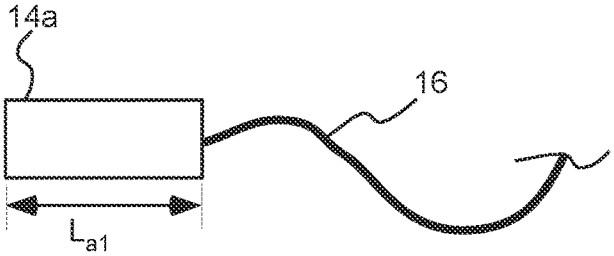
FIG. 2A (PRIOR ART)
FIG. 2A is a side view of a conventional anchor or pellet and a portion of a conventional tether of the projectile of FIG. 1.
Figure 2B:
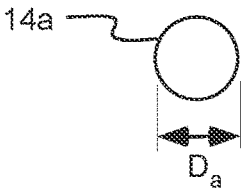
FIG. 2B (PRIOR ART)
FIG. 2B is an end view of the anchor or pellet of FIG. 2A.

Reference will now be made to the exemplary embodiments illustrated in the drawings, and specific language will be used herein to describe the same. It will nevertheless be understood that no limitation of the scope of the invention is thereby intended. Alterations and further modifications of the inventive features illustrated herein, and additional applications of the principles of the inventions as illustrated herein, which would occur to one skilled in the relevant art and having possession of this disclosure, are to be considered within the scope of the invention.

Definitions

As used herein, the singular forms "a" and "the" can include plural referents unless the context clearly dictates otherwise. Thus, for example, reference to an "anchor" can include one or more of such anchors, if the context dictates.

As used herein, the term "launcher" refers to any of a variety of devices capable of launching, propelling or otherwise discharging a projectile. Suitable examples of launchers are discussed in previous patent applications to the present Applicant, including without limitation that issued on Oct. 23, 2018 as U.S. Pat. No. 10,107,599. Other suitable launchers include, without limitation, conventional firearms, EMD (electro-muscular discharge) weapons, and various short- and long-range less-than-lethal weapons.

As used herein, when one or more hook segments are discussed as engaging "the person" of a subject, it is to be understood that such term can refer to a portion of the subject's body, e.g., an arm or leg or torso, or to an object carried by or on the subject's body, e.g., clothing, carrying packs, gloves, undergarments, etc.

As used herein, the term "substantially" refers to the complete or nearly complete extent or degree of an action, characteristic, property, state, structure, item, or result. As an arbitrary example, an object that is "substantially" enclosed is an article that is either completely enclosed or nearly completely enclosed. The exact allowable degree of deviation from absolute completeness may in some cases depend upon the specific context. However, generally speaking the nearness of completion will be so as to have the same overall result as if absolute and total completion were obtained. The use of "substantially" is equally applicable when used in a negative connotation to refer to the complete or near complete lack of an action, characteristic, property, state, structure, item, or result. As another arbitrary example, a composition that is "substantially free of" an ingredient or element may still actually contain such item so long as there is no measurable effect as a result thereof.

As used herein, the term "about" is used to provide flexibility to a numerical range endpoint by providing that a given value may be "a little above" or "a little below" the endpoint.

Relative directional terms can sometimes be used herein to describe and claim various components of the present invention. Such terms include, without limitation, "lower," "higher," "upward," "downward," "horizontal," "vertical," etc. These terms are generally not intended to be limiting, but are used to most clearly describe and claim the various features of the invention. Where such terms must carry some limitation, they are intended to be limited to usage commonly known and understood by those of ordinary skill in the art in the context of this disclosure.

As used herein, a plurality of items, structural elements, compositional elements, and/or materials may be presented in a common list for convenience. However, these lists should be construed as though each member of the list is individually identified as a separate and unique member. Thus, no individual member of such list should be construed as a de facto equivalent of any other member of the same list solely based on their presentation in a common group without indications to the contrary.

Numerical data may be expressed or presented herein in a range format. It is to be understood that such a range format is used merely for convenience and brevity and thus should be interpreted flexibly to include not only the numerical values explicitly recited as the limits of the range, but also to include all the individual numerical values or sub-ranges encompassed within that range as if each numerical value and sub-range is explicitly recited. As an illustration, a numerical range of "about 1 to about 5" should be interpreted to include not only the explicitly recited values of about 1 to about 5, but also include individual values and sub-ranges within the indicated range. Thus, included in this numerical range are individual values such as 2, 3, and 4 and sub-ranges such as from 1-3, from 2-4, and from 3-5, etc., as well as 1, 2, 3, 4, and 5, individually.

This same principle applies to ranges reciting only one numerical value as a minimum or a maximum. Furthermore, such an interpretation should apply regardless of the breadth of the range or the characteristics being described.

INVENTION

The present technology relates generally to advances in less-than-lethal launching systems developed by the present Applicant, sometimes referred to as ensnarement or entanglement systems, that can be effectively used as an aid in impeding the progress of or detaining aggressive or fleeing subjects. Devices in accordance with the present technology can be advantageously used to temporarily impede a subject's ability to walk, run, or use his or her arms. These can be advantageously used in cases where law enforcement, security personnel or military personnel wish to detain a subject, but do not wish to use lethal or harmful force or to engage in close proximity hand-to-hand combat. The technology provides a manner by which the arms or legs of a subject can be temporarily tethered or bound, to the extent that the subject finds it difficult to continue moving in a normal fashion.

While the present technology can be directed at a range of portions of a subject's body, the following discussion can sometimes focus on use of the technology to temporarily tether or bind a subject's legs. It is to be understood, however, that the present technology is not limited to this application. In some cases, multiple portions of the subject's body can be targeted, such as both the arms and the legs.

The generalized operation of the present Applicant's ensnarement devices is shown broadly in FIGS. 1-3B. These conventional systems include an entangling projectile 12 that can be deployed toward a portion of a subject's body: when the projectile contacts the body, the projectile encircles the body to thereby entangle or ensnare the subject. The projectile includes at least one flexible tether 16 and a pair of anchors or pellets 14*a*, 14*b*, coupled together by the tether. Collectively, a tether having a pair of anchors at opposing ends thereof is referred to as "a projectile." The anchors shown in FIGS. 1 through 3B are shown generically: as will be appreciated from the remaining figures, the anchors can include more sophisticated architecture where desired. By engaging a subject with the entangling projectile, the subject is temporarily rendered partially or fully incapacitated and thereby restricted in his or her ability to flee or attack. The entangling projectiles of the present technology are launched toward a subject (100 in FIGS. 3A and 3B) by a launcher. The present Applicant has developed any number of launchers with which the present anchors can be utilized, as one of ordinary skill in the art will appreciate upon review of this disclosure.

Generally speaking, a launcher for use with the present entangling projectiles will launch a projectile toward a subject 100 at a relatively high rate of speed. Typically, the projectile can be deployed toward a subject from a distance of between about 6 feet and about 30 feet (1.8 to 9.1 meters), and engages the subject within less than about 0.5 seconds (traveling between about 100-500 ft/sec (30-183 m/s) at the muzzle). After being deployed from the launcher, the entangling projectile will encircle the subject's person a plurality of times, causing the subject to be temporarily unable to effectively move. As the entangling projectile can be launched from some distance, law enforcement personnel can maintain a safe distance from a subject, yet still be able to effectively and safely temporarily restrain, disable or impede the subject.

Figure 3A:
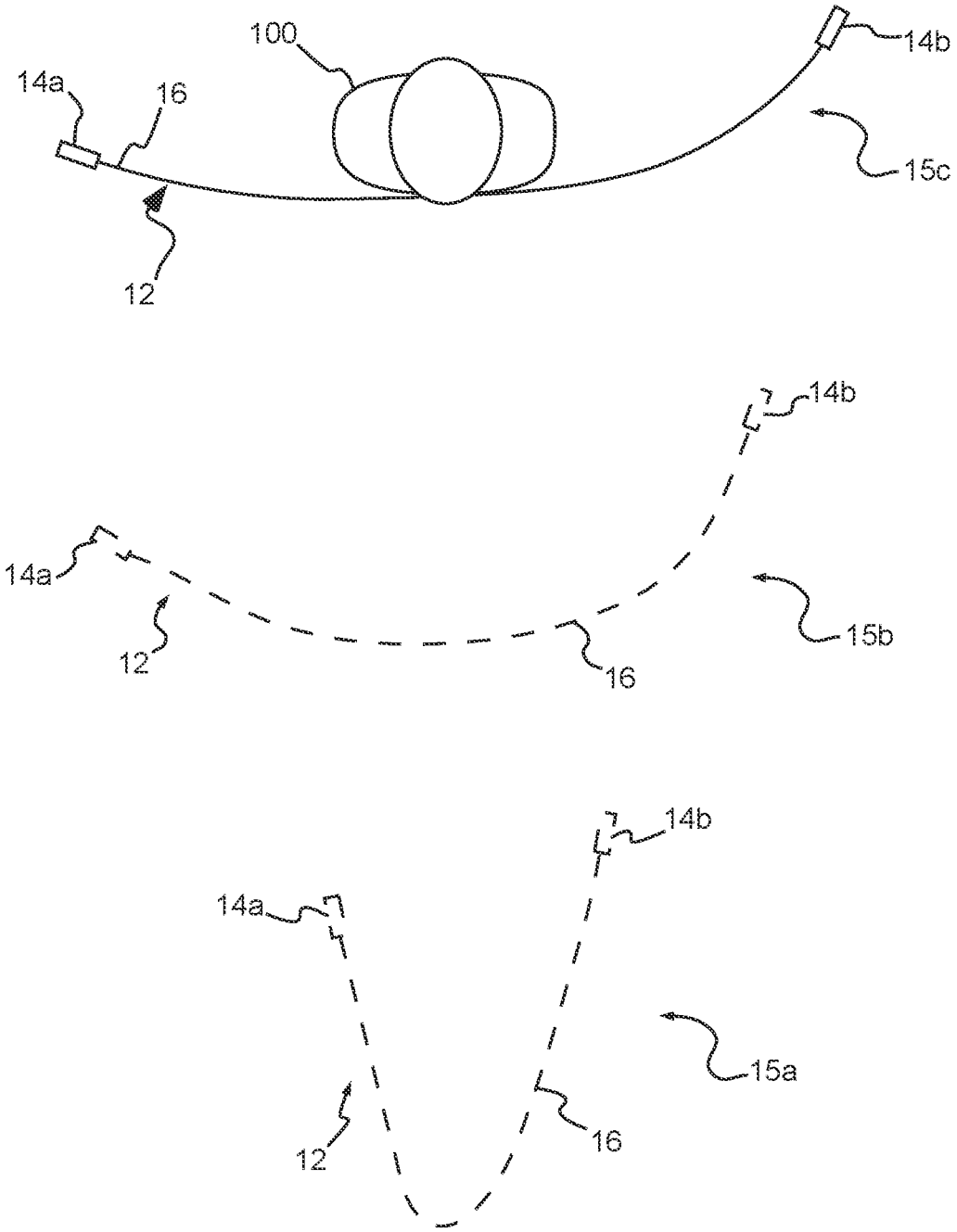
FIG. 3A (PRIOR ART)
FIG. 3A is a top view of a subject toward which a conventional entangling projectile has been launched, with the entangling projectile shown in incremental positions prior to engaging the subject.
Figure 3B:
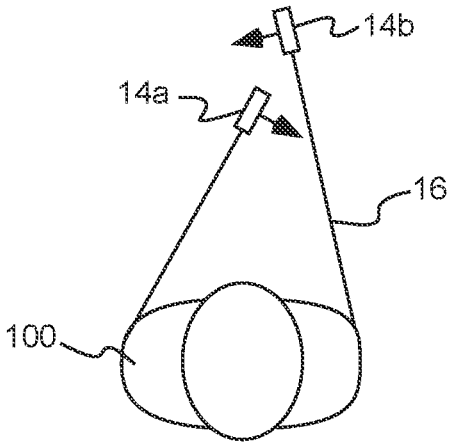
FIG. 3B (PRIOR ART)
FIG. 3B is a top view of the subject and projectile of FIG. 3A, shown shortly after the tether of the entangling projectile made contact with the subject.

Operation of the entangling projectile is shown generally in FIGS. 3A and 3B: after being released by a launcher, the projectile 12 travels toward a subject 100. As the projectile travels toward the subject, pellets 14*a*, 14*b* travel away from one another. As the anchors travel away from one another, the tether 16 is pulled into an increasingly more taut configuration. Note that, as shown in FIG. 3A, the tether may not fully reach a taut configuration prior to engaging the subject. Once the projectile engages the subject (in the example shown in these figures, the subject's legs are engaged), the pellets and tether encircle the subject and thereby temporarily entangle and/or disable the subject.

FIG. 1 illustrates the projectile 12 extended to its full length "$L_O$." In one embodiment, the overall length of the tether is much longer than the length of the anchors or pellets ($L_{a1}$). The overall length can be on the order of seven feet (2.14 meters) or greater. The pellets can have a length "$L_{a1}$" (FIG. 2A) on the order of about 1.5 inches (3.81 cm), and a diameter "Da" on the order of between about ⅛ of an inch and about ⅜ of an inch (0.32-0.95 cm). While differing embodiments of the technology can vary, it is generally desirable to maintain the pellets at a relatively small size to thereby limit the overall size requirements of the projectile casing that houses the pellets prior to deployment and to reduce the impact should a pellet contact the subject directly. In this manner, the technology can be provided in a lightweight, hand-held device.

FIGS. 3A and 3B illustrate an exemplary application of the present technology. These figures are provided to explain the basic function of the various components: it is to be understood that the relative sizes and positions of the various components in these figures may not be drawn to scale, nor may the relationship between the positions of the anchors and the tether be precisely shown. FIG. 3A illustrates a series of configurations/positions of the projectile 12 after it has been deployed from the launcher.

As shown at reference 15*a*, the tether 16 generally trails behind the anchors 14*a*, 14*b* as the anchors move forwardly and apart. At the position shown at reference 15*b*, the anchors have advanced forwardly and further apart, and have pulled the tether into a configuration more closely approximating a taut configuration. The position shown at reference 15*c* is immediately prior to the tether 16 contacting the subject 100. After this point, the anchors will begin orbiting about the subject in smaller and smaller orbits until the projectile is completely encircled about the subject. FIG. 3B illustrates the position of the anchors slightly after FIG. 3A: as can be seen, the anchors have begun encircling the subject.

Figure 4:
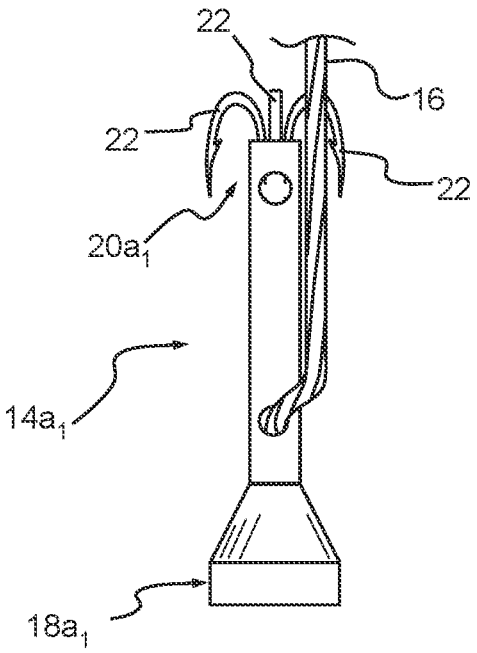
FIG. 4 (PRIOR ART)
FIG. 4 is a front view of a conventional anchor or pellet, with a portion of a tether extending therefrom.

FIG. 4 illustrates an anchor configuration utilized in the Applicant's prior systems. In this example, anchor 14*a*, includes a tail segment 18$a_1$ and a head segment 20$a_1$. Either the head segment of the tail segment of the anchor can carry one or more hook segments 22 that extend generally away from the head segment and downward (in this view) toward the tail segment. The hook segments aid in engaging the person of the subject toward which the entangling projectile has been launched. As the anchors orbit about the subject, and eventually contact the subject, the hook segments aid in at least temporarily maintaining the entangling projectile in an encircled configuration about the subject.

Figure 5:
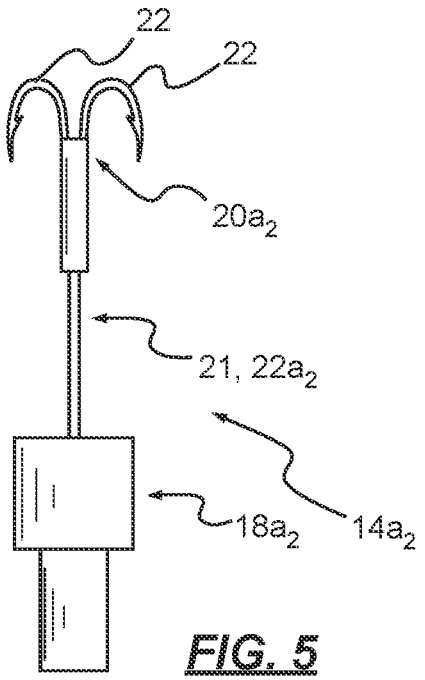
FIG. 5 is a front view of an anchor for use with an entangling projectile in accordance with an embodiment of the technology.
Figure 6:
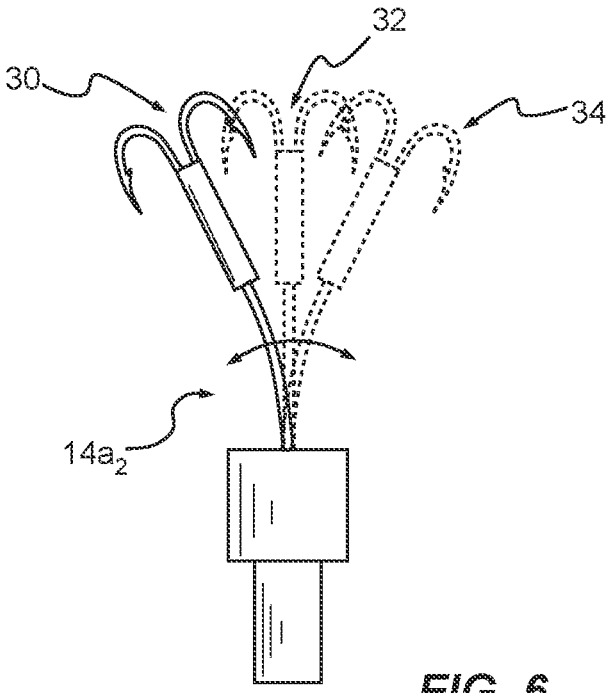
FIG. 6 is a front view of the anchor of FIG. 5, shown through a series of different possible configurations.

Turning to FIGS. 5 though 8, in one aspect of the present technology, an anchor 14$a_2$ is provided for use as a portion of an entangling projectile. The anchor can include at least two segments, including a tail segment 18$a_2$ and a head segment 20$a_2$. In this embodiment, the at least two segments can be positionable relative to one another in at least a first, primary configuration, e.g., the configuration shown in FIG. 5, and at 32 in FIG. 6. The segments can also be positionable relative to one another in at least a second, displaced configuration, e.g., the configuration shown for example at positions 30 or 34 in FIG. 6. A biasing element, in this example item 21 in FIG. 5, can be associated with one or both of the head segment and the tail segment. The biasing element can be operable to apply a restorative force to one or both of the head segment and the tail segment. The restorative force tends to return the respective segments into the primary configuration after being moved into the displaced configuration.

The biasing element 21 in this embodiment thus serves two primary purposes: 1) it allows the tail segment 18$a_2$ and the head segment 20$a_2$ to be moved from the primary configuration upon application of some force; and 2) it provides a force that tends to return the head and tail segments into the primary configuration once said force is removed. As such, the biasing element is non-deformably or elastically moveable from its orientation in the primary configuration to its orientation in the displaced configuration.

In the example shown in FIGS. 5 through 8, anchor 14$a_2$ includes a shank segment 22$a_2$ that extends from the tail segment 18$a_2$ to the head segment 20$a_2$. In this particular embodiment, the shank segment also serves as the biasing element 21. The shank segment can be formed from a suitable material that can non-deformably move from the primary configuration to the displaced configuration. In one aspect, the shank segment/biasing element is formed from a material commonly known as piano wire, and includes a diameter of about 0.020 inches. Piano wire is generally formed from tempered, high-carbon steel, also known as spring steel, that exhibits a very high tensile strength. Due to the size and makeup of the shank segment, the wire is very resistant to compression and tension loads, while also providing the ability to laterally bend from one side to another. In other words, the biasing element in this example is non-deformably displaceable laterally, but is substantially unextendible and incompressible during normal use.

Figure 8:
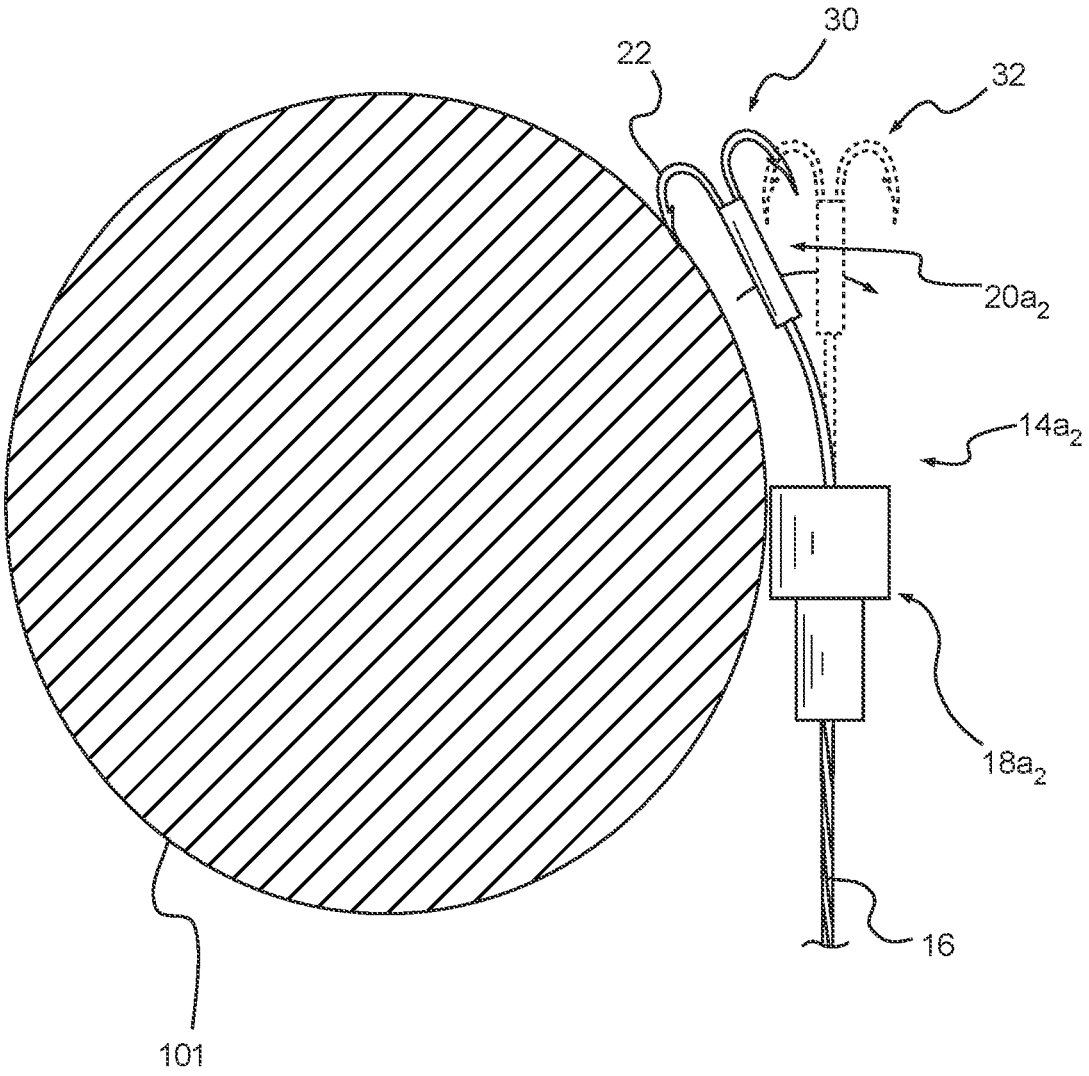
FIG. 8 illustrates one example of the manner in which the anchor of FIG. 5 appears upon engaging a portion of a subject's body.

In this embodiment, the head portion 20$a_2$ can carry one or more hook segments 22 that can be operable to engage the person of a subject about which the entangling projectile has been deployed. While the hooks are capable of engaging the skin of a subject, it is much more common for the hooks to engage clothing worn by the subject. FIG. 8 illustrates one example of the manner in which the various components of the anchor interact to engage a portion 101 of a subject. In this example, the portion 101 can be any portion of the subject: a leg, arm, torso, clothing, etc. Note that the portion 101 is not shown to scale in this figure: the portion will generally be much larger than the pellet: this figure is simplified to more easily illustrate the function of the anchor. As the anchor 18$a_2$ finishes encircling the portion 101 of the subject, it is generally traveling at very high speed. As soon as the hook segment 22 comes into contact with the portion of the body, it tends to engage this portion to hold the anchor in position, which thereby maintains the entire entangling projectile in position about the subject to thereby entangle the subject. While the hook segments have proven to increase the likelihood of a successful engagement with the subject, there are still times when the hook segments fail to engage, or to remain engaged, with the portion of the subject.

The present anchors can greatly increase the likelihood of a successful engagement as the biasing element tends to apply a restorative force to the hook segment immediately after impact, which tends to "set" the hook within the structure it engaged. In this manner, less aggressive hook configurations can be utilized, as a successful "set" can be achieved even with less pronounced hook angles or profiles. In the example shown in FIG. 8, the tail portion 18$a_2$ likely first contacted the portion 101, with the tether 16 likely being pulled fairly taut by the momentum of the anchors orbiting the subject. Once the tail segment contacts the portion 101, the head portion 20$a_2$ will continue to travel, causing the shank segment/biasing element to bend laterally, until the hook segment engages the portion. That is, the anchor is initially in the primary configuration upon initial contact, but bends into the displaced configuration immediately thereafter. The biasing forces thus created in the shank segment/biasing element will then tend to pull the head segment (and thereby the hook segments) back into the primary configuration. This causes the hook segments to more securely cinch into the portion 101 that was initially contacted: that is, it tends to "set" the hook into the portion initially contacted. As the tether is very often sufficiently taut at this time (aided, likely, by the subject struggling against the encircled tether), the resulting forces applied to the hook segment tend to maintain it in engagement with the portion 101 that is initially engaged, resulting in much lower likelihood that the hook segment will disengage.

Figure 7:
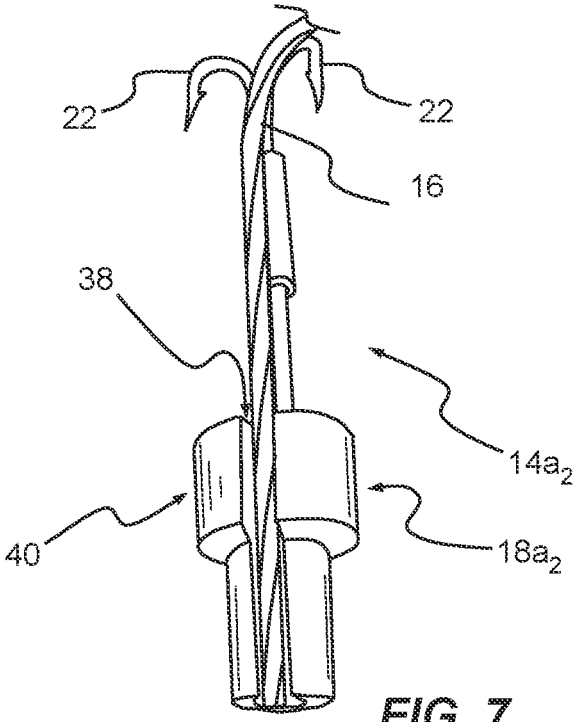
FIG. 7 is a perspective view of the anchor of FIG. 5, shown with a portion of a tether extending therefrom.

Tether 16 can be attached to the tail portion 18$a_2$ in a variety of manners. Two anchors are generally utilized with a single tether to constitute a single entangling projectile, with an anchor at each end of a tether. In the terminology used herein, the tail segment is generally that to which the tether is coupled, with the head segment generally that to which the hook segments are coupled. In this case, as shown in FIG. 7, the tether may need to be fed beyond the tail portion toward the front of a launcher (not shown). In the example anchor 14$a_2$ shown, the tail segment 18$a_2$ can include a recessed slot 38 formed therein. The tether 16 can be positioned within the recessed slot so as to be thereby recessed beneath a largest outer diameter 40 of the tail segment. This can advantageously allow the tether to be routed beyond the tail section within the bore of a socket or other structure within a launcher without interfering with the generally very close tolerance between the outer diameter of the tail section and the inner bore of such socket.

Figure 9:
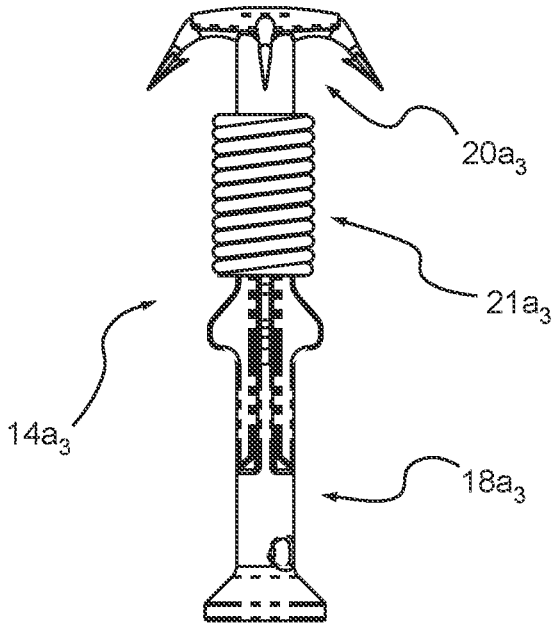
FIG. 9 is a front view of an anchor for use with an entangling projectile in accordance with another embodiment of the technology, shown in a primary configuration.
Figure 10:
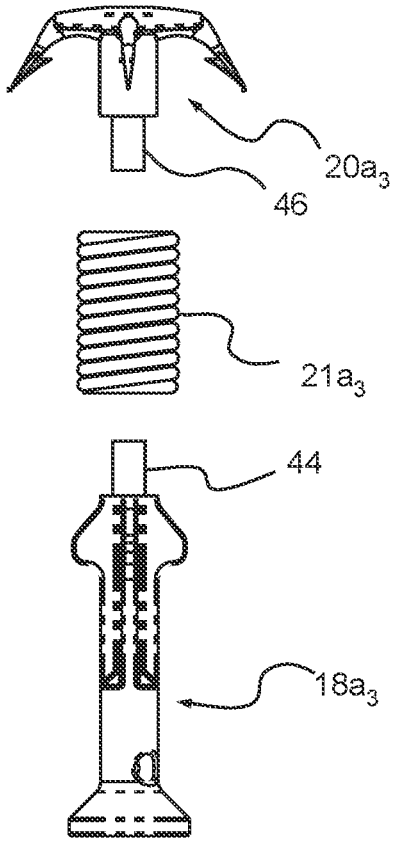
FIG. 10 is a partially exploded view of the anchor of FIG. 9.
Figure 11:
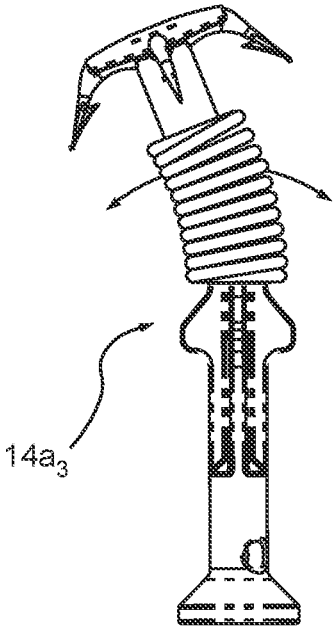
FIG. 11 is a front view of the anchor of FIG. 9, shown in a displaced configuration.

FIGS. 9 through 11 illustrate a further embodiment of the technology. In this example, anchor 14$a_3$ includes a tail segment 18$a_3$, a head segment 20$a_3$, and a biasing element 21$a_3$. FIG. 9 illustrates this anchor in the primary configuration. In this example, the biasing element includes a coil spring that is displaceable laterally, provides some degree of extension in tension, but is resistant to compressive forces (at least while in the primary configuration shown in FIG. 9). As shown in FIG. 10, tail segment can include an extension portion 44 and head segment can include an extension portion 46, each of which can be installable within an inner core of the coil spring. Thus, the coil spring serves to connect or couple the head segment to the tail segment. FIG. 11 illustrates the anchor 14$a_3$ in a displaced configuration: one of ordinary skill in the art will readily appreciate the tendency of this spring to return to the primary configuration shown in FIG. 9 once the load causing the deflection in FIG. 11 has been removed.

Figure 12:
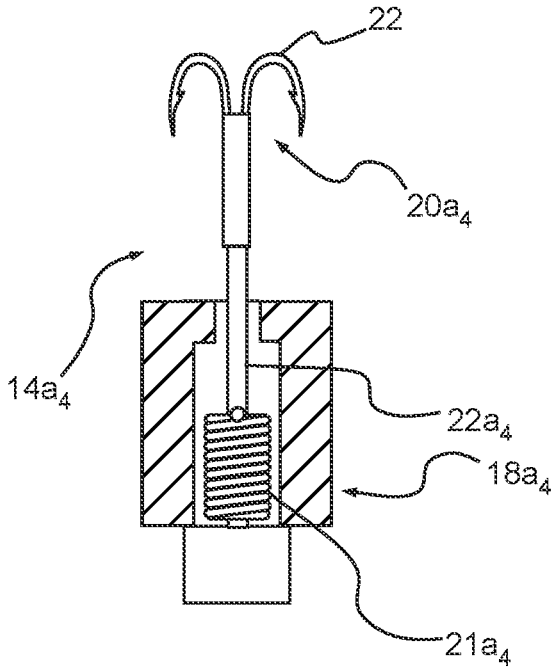
FIG. 12 is a front, partially sectioned view of an anchor for use with an entangling projectile in accordance with another embodiment of the technology, shown in a primary configuration.
Figure 13:
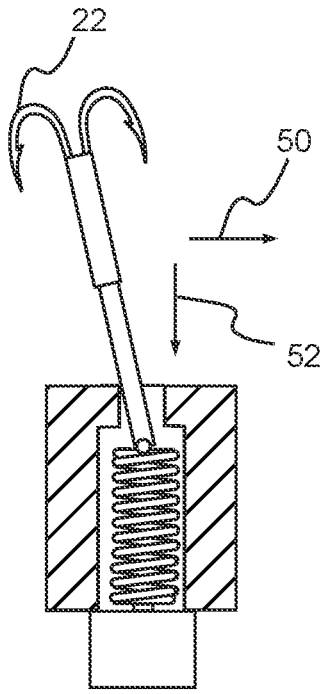
FIG. 13 is a front view of the anchor of FIG. 12, shown in a displaced configuration.

FIGS. 12 and 13 illustrate yet another embodiment of the technology in which anchor 14$a_4$ includes tail segment 18$a_4$, shank segment 22$a_4$ and head segment 20$a_4$. In this element, a separate biasing element, in the form of a coil spring 21$a_4$, can be pivotally coupled to each of the tail segment and the shank segment. In this embodiment, while the shank segment may or may not be flexible, the coil spring allows both the shank segment and the head segment to deflect laterally, but then provides a restorative force that tends to return them both to the primary configuration upon release of the force that caused the segments to move from the primary configuration. As shown by indicators 50, 52, the coil spring will apply forces in two directions to the hook segment 22, which can aid in retaining the hook segment in contact with the person of the subject.

Figure 14:
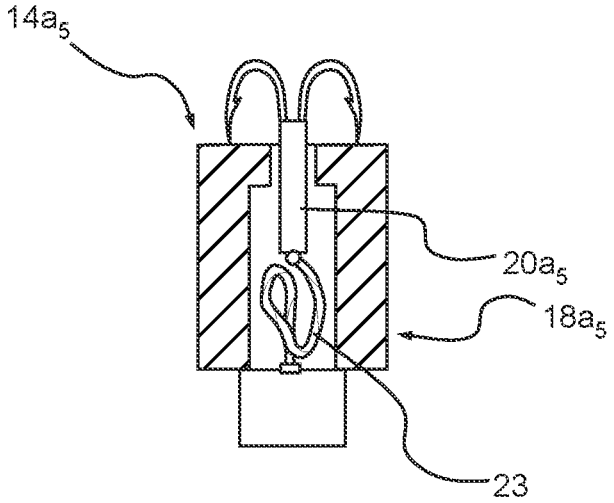
FIG. 14 is a front, partially sectioned view of an anchor for use with an entangling projectile in accordance with another embodiment of the technology, shown in a primary configuration.
Figure 15:
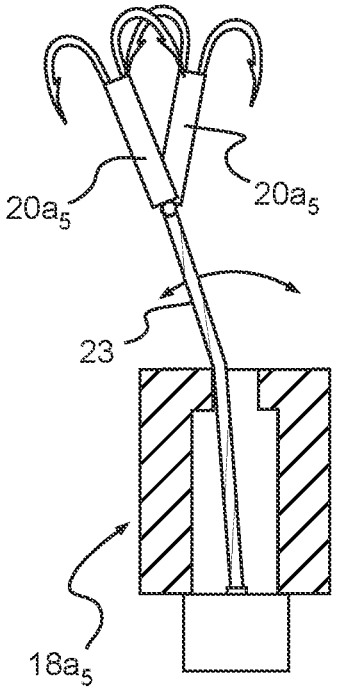
FIG. 15 is a front view of the anchor of FIG. 14, shown in a displaced configuration.

FIGS. 14 and 15 illustrate another embodiment of the invention in which a flexible element 23 extends between tail segment 18$a_5$ and head segment 20$a_5$ of anchor 14$a_5$. The flexible element can be formed from the same material of which the tether 16 is formed, or a variety of other suitable materials that allow the head segment to be articulated, or positioned in a variety of positions, relative to the tail segment after launch. This can allow the hooks of the head segment to more easily engage the person of the subject, as the head segment can be forced rapidly against an arm, leg or torso of the subject after the tail segment contacts the subject. The flexible segment can allow the head portion to be "whipped" or "lashed" against the subject's person, resulting in a higher likelihood of a successful engagement.

As is shown in FIGS. 14 and 15, the flexible element 23 can be stored within the tail segment 18$a_5$ prior to launch, with at least a portion of the head segment 20$a_5$ also stored within the tail segment. Once deployed, the flexible element can allow the head segment, and thus the hook segments, to extend away from the tail segment and articulate freely relative to the tail segment. In one embodiment, as shown by example in FIG. 15, the flexible element 23, or the biasing elements discussed in previous elements, can include a plurality of hook segments that can be coupled to the flexible element. In addition, each hook segment can include its own flexible element: that is, multiple flexible segments can be coupled within the tail segment, each having its own hook segment attached thereto. In each case, the flexible element or hook segments can nest, or be stored within, another component of the anchor. Generally, the flexible element is separate from and independent of the tether portion: it will generally extend from the anchor in the opposite direction from the tether.

Accordingly, in one embodiment of the technology, an entangling projectile for use in a launcher can be provided. The entangling projectile can include a pair of anchors, each anchor including: a head segment and a tail segment, the head segment and tail segment being positionable relative to one another in at least a first, primary configuration and a second, displaced configuration. A flexible element can be intermediate the head segment and the tail segment. The flexible element can be operable to allow relative movement between the head segment and the tail segment to allow the tail segment to articulate relative to the head segment. One or more hook segments can be carried by the head portion, the one or more hook segments operable to engage the person of a subject about which the entangling projectile has been deployed. A tether can be coupled to and can extend between each of the anchors. The tether can be separate from and independent of the flexible element.

Figure 16A:
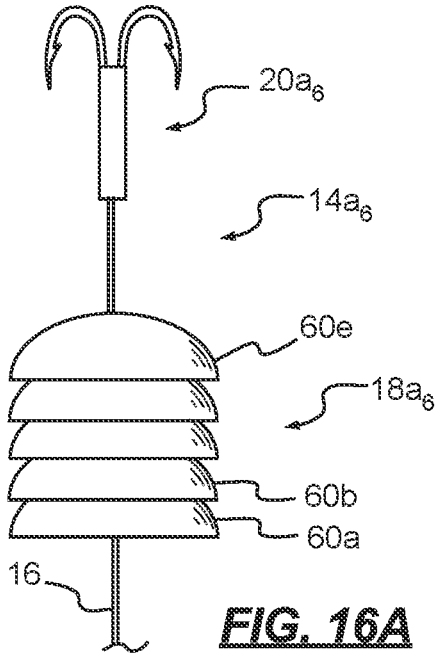
FIG. 16A is a front view of an anchor in accordance with another aspect of the technology.
Figure 16B:
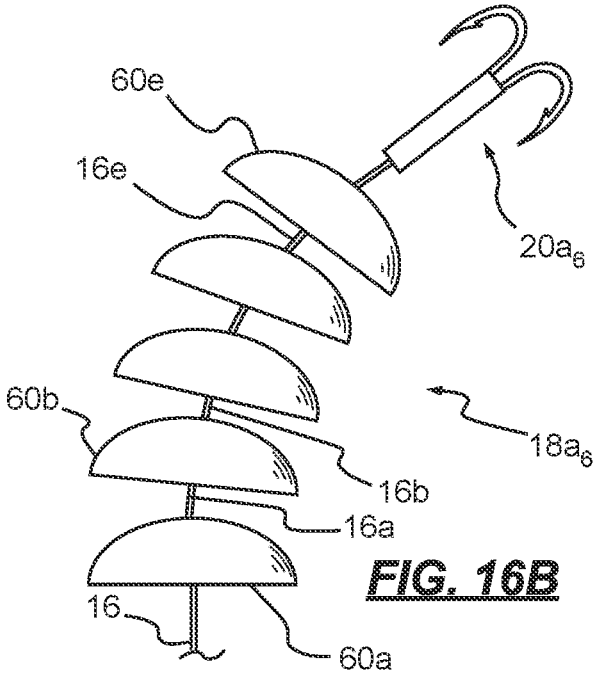
FIG. 16B is a front view of the anchor of FIG. 16A, shown in an extended or displaced configuration.

For example, as shown in FIGS. 16A and 16B, in one aspect of the technology, anchor $\mathbf{14}a_6$ can include a tail segment $\mathbf{18}a_6$ and a head segment $\mathbf{20}a_6$. The tail segment $\mathbf{18}a_6$ can include a series of elements 60*a*, 60*b*, 60*e*, etc., that can nest one within another when in the primary configuration shown in FIG. 16A. In FIG. 16B, the anchor $\mathbf{14}a_6$ is shown in a displaced configuration. In this example, each of the elements can comprise at least a partially hollow shell that allows them to stack one atop another. Each of a series of tethers or tether segments 16*a*, 16*b*, 16*e*, etc., can extend between each of the elements. When stacked, as shown in FIG. 16A, the tether or tether segments can be stored in the space between elements 60. When the anchor is in the displaced configuration (FIG. 16B), the tether or tether segments allow the individual shell elements to articulate relative to one another. This can aid in ensuring the anchor successfully engages the subject upon contact. Edges of the shell elements can engage the person of the subject while the overall design allows the anchor to conform to the person of the subject.

Figure 17A:
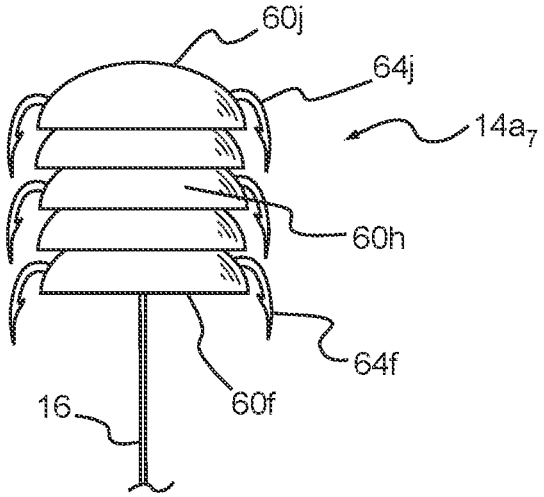
FIG. 17A is a front view of an anchor in accordance with another aspect of the technology.
Figure 17B:
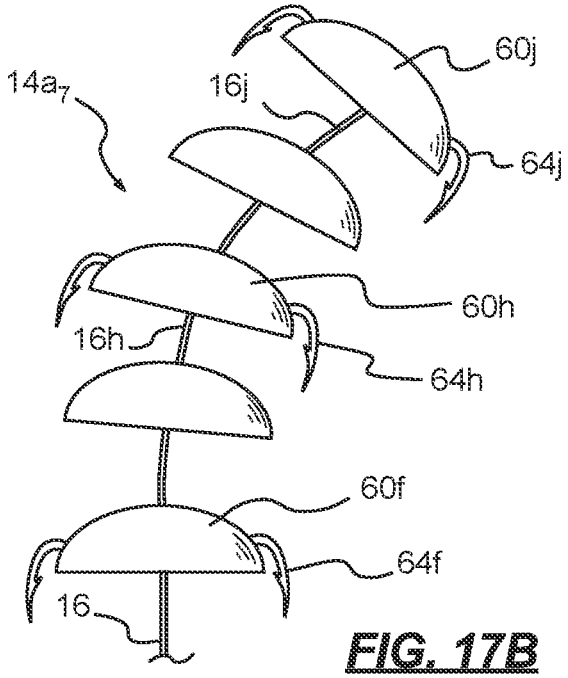
FIG. 17B is a front view of the anchor of FIG. 17A, shown in an extended or displaced configuration.

In the example shown in FIGS. 17A and 17B, anchor $\mathbf{14}a_7$ can include only a segment analogous to those discussed above as a tail segment. In this example, each of a series of elements 60*f*, 60*h*, 64*j* etc., can be arranged in a nesting configuration, similar to the arrangement of FIGS. 16A and 16B. A tether or tether segments 16*h*, 16*j*, etc., can join each of the elements, and can be stored within the space between two elements when the anchor is in the configuration shown in FIG. 17A. In this example, however, one or more of the elements 60*f*, 64*h*, etc., can include a hook or hook segment 64*f*, 64*h*, etc. While only some of the elements are shown carrying a hook segment, it is to be understood than only one of the segments can carry a hook segment, or all of the segments can carry a hook segment. Edges of the shell elements 60*f*, 60*h*, etc., can engage the person of the subject in addition to each of the hook segments 64*g*, 64*h*, etc. The flexibility or articularity of the overall design allows the anchor to conform to the person of the subject.

In addition to the structure outlined above, the present technology also provides various methods of configuring anchors and/or entangling projectiles, methods of utilizing such systems, methods of associating such systems with various projectile launchers, and methods of utilizing projectile launchers carrying such systems.

It is to be understood that the above-referenced arrangements are illustrative of the application for the principles of the present invention. Numerous modifications and alternative arrangements can be devised without departing from the spirit and scope of the present invention while the present invention has been shown in the drawings and described above in connection with the exemplary embodiments(s) of the invention. It will be apparent to those of ordinary skill in the art that numerous modifications can be made without departing from the principles and concepts of the invention as set forth in the examples.

We claim:

1. An anchor for use in an entangling projectile, the anchor comprising:

at least two segments, including a head segment and a tail segment, each of said head segment and the tail segment including an extension portion, the at least two segments being positionable relative to one another in at least a first, primary configuration and a second, laterally displaced configuration;

a coil spring having an inner core, each of the extension portions of the head and tail segments installed within an opposing end of the inner core of the coil spring, the coil spring operable to apply a restorative force to one or both of the head segment and the tail segment, the restorative force tending to return the respective segments into the primary configuration after being laterally moved into the displaced configuration; and one or more hook segments carried by the head segment, the one or more hook segments operable to engage the person of a subject about which the entangling projectile has been deployed.

2. The anchor of claim 1, wherein the coil spring is displaceable laterally, but is substantially incompressible when the head and tail segments are in the primary configuration.

3. The anchor of claim 1, further comprising a tether, coupled to and extending from the tail segment.

4. The anchor of claim 3, further comprising a second anchor, coupled to an opposing end of the tether.

5. The anchor of claim 3, wherein the tail segment includes a recessed slot formed therein, the tether being positionable within the recessed slot so as to be recessed beneath an outer surface of the tail segment.

6. An anchor for use in an entangling projectile, the anchor comprising:

a head segment and a tail segment, each of said head and tail segments including an extension portion and being positionable relative to one another in at least a first, primary configuration and a second, laterally displaced configuration;

a coil spring having an inner core, each of said extension portions of said head and tail segments installed within an opposing end of the inner core of the coil spring, the coil spring operable to apply a restorative force to one or both of the head segment and the tail segment, the restorative force tending to return the respective segments into the primary configuration after being moved into the laterally displaced configuration; and one or more hook segments carried by the head segment, the one or more hook segments operable to engage the person of a subject about which the entangling projectile has been deployed.

7. The anchor of claim 6, wherein the coil spring is displaceable laterally, but is substantially incompressible when the head and tail segments are in the primary configuration.

8. An entangling projectile for use in a launcher, the entangling projectile comprising:

a pair of anchors, each anchor including:

a head segment and a tail segment, each including an extension portion, the head segment and tail segment being positionable relative to one another in at least a first, primary configuration and a second, laterally displaced configuration;

a coil spring having an inner core, each of said extension portions of said head and tail segments installed within an opposing end of the inner core of the coil spring, the coil spring operable to apply a restorative force to one or both of the head segment and the tail segment, the restorative force tending to return the respective segments into the primary configuration after being moved into the laterally displaced configuration; and one or more hook segments carried by the head segment, the one or more hook segments operable to engage the person of a subject about which the entangling projectile has been deployed; and a tether, coupled to and extending between each of the respective tail segments.

9. The entangling projectile of claim 8, wherein the coil spring is displaceable laterally, but is substantially incompressible when the head and tail segments are in the primary configuration.

10. The entangling projectile of claim 8, wherein each said tail segment includes a recessed slot formed therein, the tether being positionable within each said recessed slot so as to be recessed beneath an outer surface of each said tail segment.

* * * * *